US009412536B2

(12) United States Patent
Chen et al.

(10) Patent No.: US 9,412,536 B2
(45) Date of Patent: Aug. 9, 2016

(54) ILLUMINATED KEYBOARD

(71) Applicant: Primax Electronics Ltd., Neihu, Taipei (TW)

(72) Inventors: Bo-An Chen, Taipei (TW); Hsien-Tsan Chang, Taipei (TW)

(73) Assignee: PRIMAX ELECTRONICS LTD. (TW)

( * ) Notice: Subject to any disclaimer, the term of this patent is extended or adjusted under 35 U.S.C. 154(b) by 281 days.

(21) Appl. No.: 14/104,483

(22) Filed: Dec. 12, 2013

(65) Prior Publication Data

US 2015/0107975 A1 Apr. 23, 2015

(30) Foreign Application Priority Data

Oct. 18, 2013 (TW) ..... 102137735 A

(51) Int. Cl.
*H01H 13/83* (2006.01)

(52) U.S. Cl.
CPC ..... *H01H 13/83* (2013.01); *H01H 2219/039* (2013.01); *H01H 2219/0621* (2013.01)

(58) Field of Classification Search
CPC ..... H01H 13/023; H01H 13/02
USPC ..... 341/20, 22; 200/5 A, 314; 362/26, 85
See application file for complete search history.

(56) References Cited

U.S. PATENT DOCUMENTS

2007/0296701 A1* 12/2007 Pope ..... G06F 1/3215 345/168
2009/0201179 A1* 8/2009 Shipman ..... G06F 3/0202 341/22
2013/0050233 A1* 2/2013 Hirsch ..... G06F 3/038 345/589
2013/0068601 A1* 3/2013 Sellers ..... G06F 3/0202 200/5 A
2014/0034467 A1* 2/2014 Chou ..... H01H 3/125 200/5 A
2014/0035818 A1* 2/2014 Matsuoka ..... G06F 1/3231 345/168
2014/0139441 A1* 5/2014 Chen ..... G06F 3/0202 345/170
2014/0168935 A1* 6/2014 Chen ..... G02B 6/0083 362/23.03
2014/0183018 A1* 7/2014 Chou ..... H01H 13/83 200/5 A
2015/0021151 A1* 1/2015 Chen ..... H01H 13/83 200/5 A

* cited by examiner

*Primary Examiner* — Albert Wong
(74) *Attorney, Agent, or Firm* — Kirton McConkie; Evan R. Witt

(57) ABSTRACT

An illuminated keyboard includes at least one light-emitting element, a membrane switch circuit module, plural keys, a fixing plate, and a proximity sensor. The fixing plate includes plural openings, plural joining regions, and plural fixing regions. The plural fixing regions are arranged between the plural openings for fixing plural elastic elements of the plural keys. The proximity sensor includes an induction antenna circuit. The induction antenna circuit is formed on the plural joining regions or the plural fixing regions of the fixing plate for sensing whether an object enters a sensing range.

13 Claims, 7 Drawing Sheets

ILLUMINATED KEYBOARD

FIELD OF THE INVENTION

The present invention relates to an illuminated keyboard, and more particularly to an illuminated keyboard having a function of sensing whether an object enters a sensing range.

BACKGROUND OF THE INVENTION

Generally, a keyboard is a peripheral device for inputting characters or commands into an information apparatus such as a desktop computer, a notebook computer, a mobile phone or a tablet computer. FIG. 1 is a schematic top view illustrating the outer appearance of a conventional keyboard. As shown in FIG. 1, there are plural keys 10 on a surface of the conventional keyboard 1. When one of these keys 10 is depressed by the user's finger, a corresponding signal is issued to the information apparatus, and thus the information apparatus executes a function corresponding to the depressed key. For example, when the key 101 is depressed, a corresponding English letter or symbol is inputted into the information apparatus. When the key 102 is depressed, a corresponding number is inputted into the information apparatus. When the function key 103 is depressed, a corresponding function is quickly executed.

In case that the keyboard is used in a dim environment, the numbers and the characters marked on the keys of the keyboard are not clearly visible. In other words, the dim environment becomes hindrance from operating the keyboard. For solving these drawbacks, an illuminated keyboard has been introduced into the market.

Generally, after the conventional illuminated keyboard is manually turned on by the user, a light-emitting element is driven to emit a light beam. Moreover, after the conventional illuminated keyboard is manually turned off by the user, the light-emitting element stops emitting the light beam. As known, the way of manually controlling the illuminating function of the conventional illuminated keyboard is not user-friendly. Moreover, the illuminating function of the illuminated keyboard is usually enabled by the user in the dim environment. However, after the illuminated keyboard is used, the user often forgets disabling the illuminating function of the illuminated keyboard. Consequently, even if the illuminated keyboard is used in a bright environment or the illuminated keyboard is not used by any user, the light-emitting element still emits the light beam. In other words, the use of the conventional illuminated keyboard has the problem of wasting electric power.

For solving the above drawbacks, an illuminated keyboard with a proximity sensor is disclosed. FIG. 2 is a schematic cross-sectional view illustrating an illuminated keyboard with a proximity sensor. This illuminated keyboard 2 is disclosed in Chinese utility model patent Nos. CN201440241. As shown in FIG. 2, the illuminated keyboard 2 comprises a keycap layer 21, a light guide plate 22, a metal resilience layer 23, a membrane circuit board 24, at least one light emitting diode 25, an induction processing device 26, an induction antenna 27, and a keyboard housing 28. The induction processing device 26 is located at a side of an inner portion of the keyboard housing 28. The induction antenna 27 is electrically connected with the induction processing device 26.

When a user is located near the illuminated keyboard 2, the induction processing device 26 senses whether the user enters the sensing range according to the detecting result of the induction antenna 27. Consequently, the light emitting diode 25 is automatically turned on or turned off. In Chinese utility model patent Nos. CN201440241, the induction antenna 27 is directly printed on the membrane circuit board 24 or circularly disposed within the keyboard housing 28. In case that the induction antenna 27 is printed on the membrane circuit board 24, the induction antenna 27 should be separated from the traces of the membrane circuit board 24. Under this circumstance, the position of installing the induction antenna 27 is restricted. Whereas, in case that the induction antenna 27 is circularly disposed within the keyboard housing 28, the size of the keyboard housing 28 should be large enough to accommodate the induction antenna 27. Under this circumstance, the illuminated keyboard fails to meet the requirements of light weightiness, slimness and miniaturization. In the above two situations, since the induction antenna 27 is very close to the metal resilience layer 23, a signal interference problem occurs.

Therefore, there is a need of providing an improved illuminated keyboard with a proximity sensor in order to eliminate the above drawbacks.

SUMMARY OF THE INVENTION

An object of the present invention provides an illuminated keyboard with a proximity sensor in order to meet the slimness requirement and achieve enhanced induction efficacy.

In accordance with an aspect of the present invention, there is provided an illuminated keyboard. The illuminated keyboard includes at least one light-emitting element, a membrane switch circuit module, plural keys, a fixing plate, and a proximity sensor. The at least one light-emitting element provides a light beam to the illuminated keyboard. The membrane switch circuit module generates plural key switch signals. The plural keys are disposed over the membrane switch circuit module. When one of the plural keys is depressed, the membrane switch circuit module generates the corresponding key switch signal. Each of the plural keys includes an elastic element and a keycap connected with the elastic element. The fixing plate is arranged between the membrane switch circuit module and the plural keys. The fixing plate includes plural openings, plural fixing regions, and plural joining regions. The plural openings are disposed under each of the plural keycaps. The plural fixing regions are disposed under the plural keycaps, respectively. Each of the plural fixing regions is arranged between the plural openings under the corresponding keycap so as to fix the corresponding elastic element. Each of the plural fixing regions has a hole, and the corresponding elastic element is penetrable through the hole to push the membrane switch circuit module. The openings between the plural fixing regions are connected with each other through the plural joining regions. The proximity sensor senses whether an object enters a sensing range. The proximity sensor includes an induction antenna circuit. The induction antenna circuit is formed on the plural joining regions or the plural fixing regions of the fixing plate.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 3:
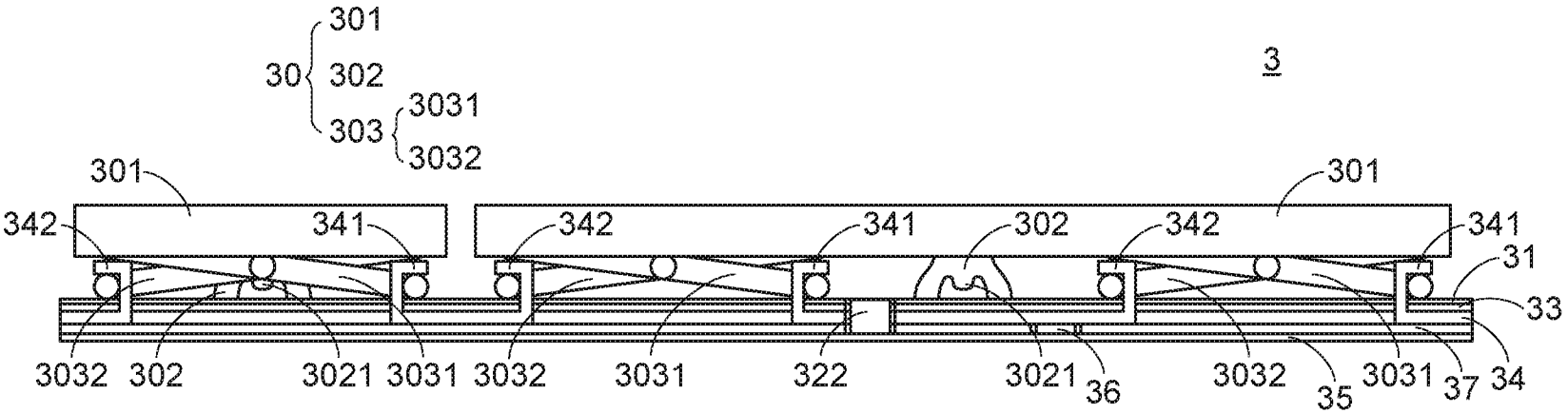
FIG. 3 is a schematic cross-sectional view illustrating an illuminated keyboard according to an embodiment of the present invention.
Figure 4:
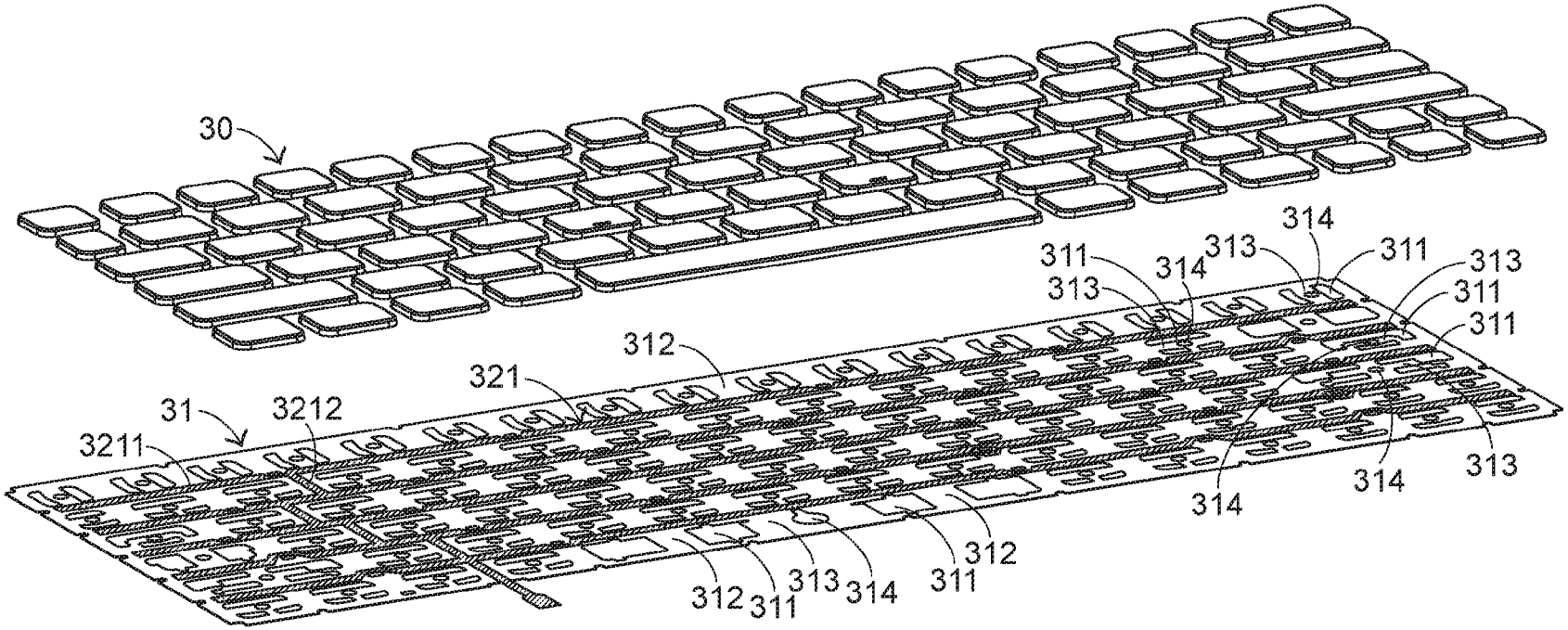
FIG. 4 schematically illustrates a first exemplary induction antenna circuit used in the illuminated keyboard of the present invention.
Figure 5:
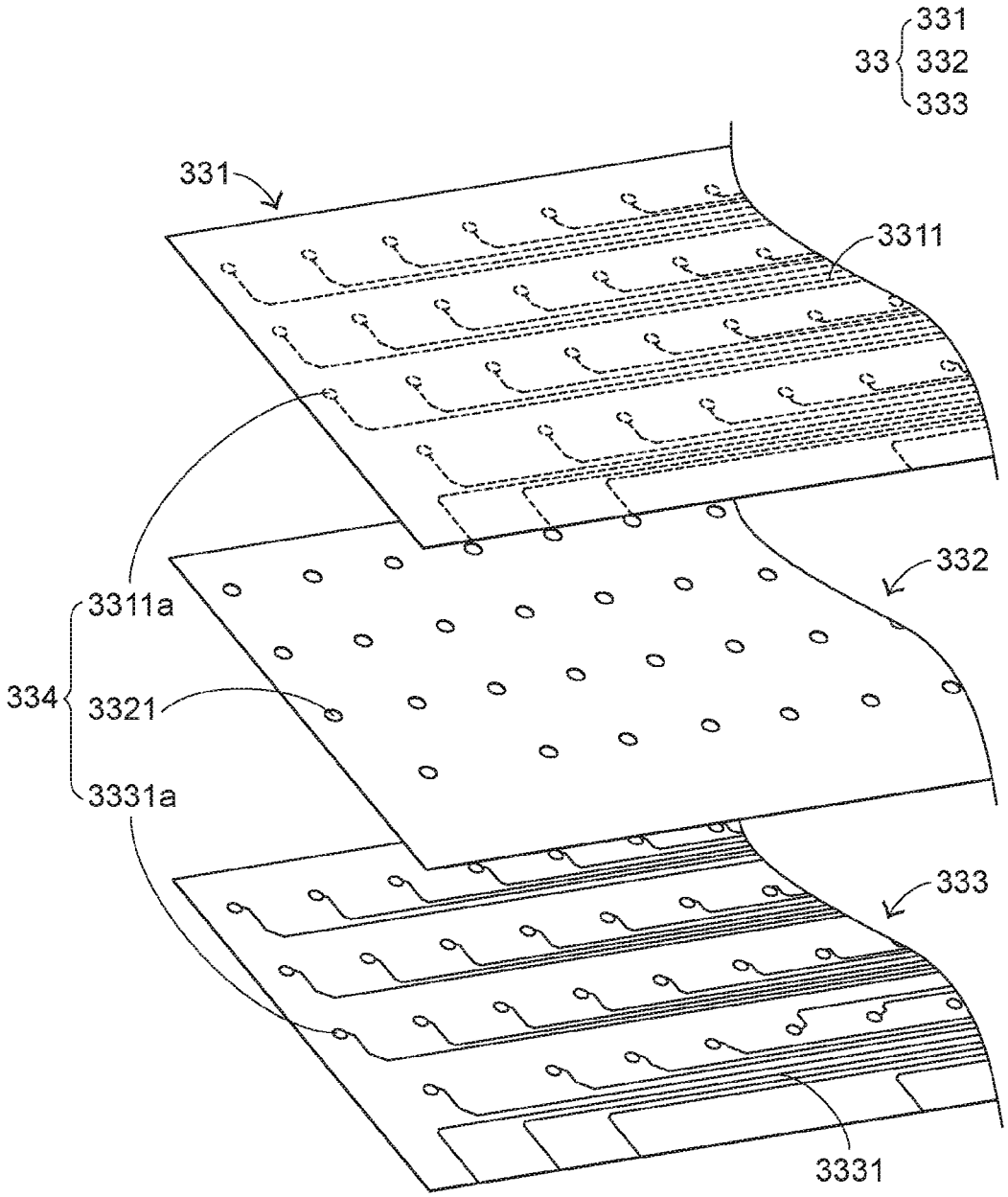
FIG. 5 is a schematic exploded view illustrating a membrane switch circuit module used in the illuminated keyboard of the present invention.
Figure 6:
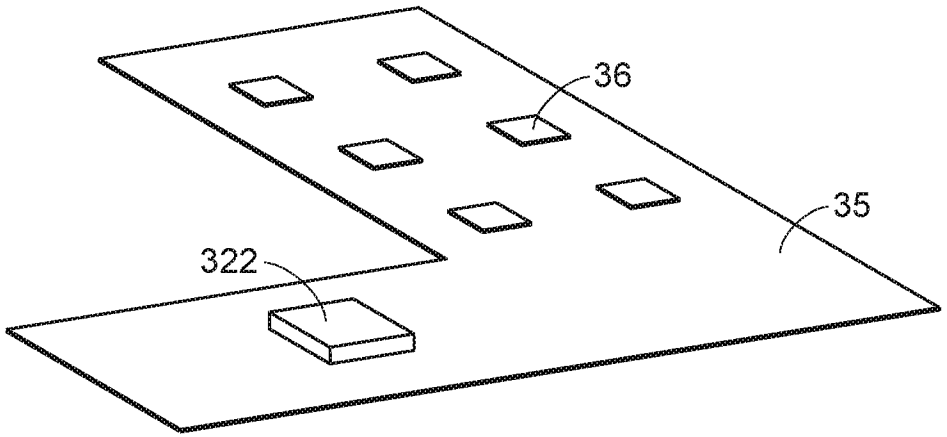
FIG. 6 is a schematic perspective view illustrating an illumination circuit board used in the illuminated keyboard of the present invention.

Hereinafter, an illuminated keyboard with a proximity sensor according to an embodiment of the present invention will be illustrated with reference to FIGS. 3~6. FIG. 3 is a schematic cross-sectional view illustrating an illuminated keyboard according to an embodiment of the present invention. FIG. 4 schematically illustrates a first exemplary induction antenna circuit used in the illuminated keyboard of the present invention. FIG. 5 is a schematic exploded view illustrating a membrane switch circuit module used in the illuminated keyboard of the present invention. FIG. 6 is a schematic perspective view illustrating an illumination circuit board used in the illuminated keyboard of the present invention. It is noted that the structure and the circuit pattern of the illuminated keyboard as shown in FIGS. 3~6 are presented herein for purpose of illustration and description only.

Figure 1:
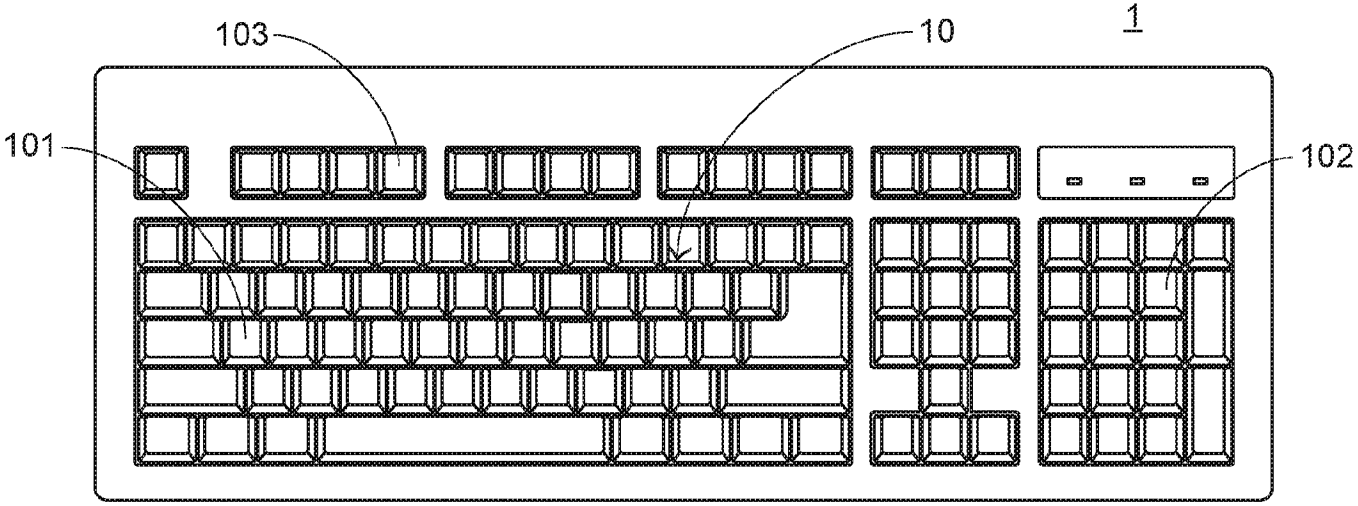
FIG.1 PRIOR ART
FIG. 1 is a schematic top view illustrating the outer appearance of a conventional keyboard.
Figure 2:
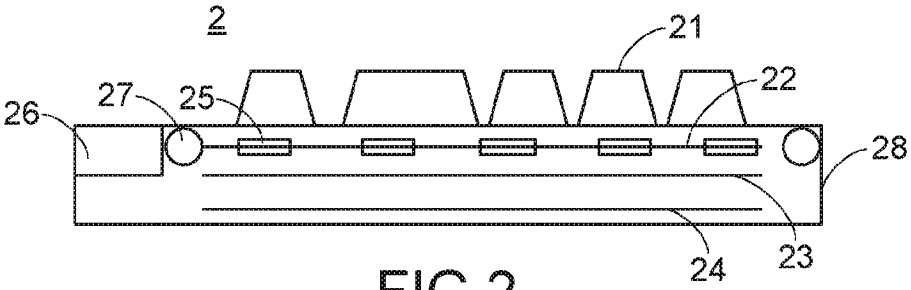
FIG.2 PRIOR ART
FIG. 2 is a schematic cross-sectional view illustrating an illuminated keyboard with a proximity sensor.

In comparison with the conventional illuminated keyboard of FIG. 2, the illuminated keyboard 3 of the present invention comprises a fixing plate 31 under plural keys 30, and plural elastic elements 302 and an induction antenna circuit 321 of a proximity sensor are all disposed on the fixing plate 31.

The components of the illuminated keyboard 3 will be illustrated in more details as follows. Please refer to FIGS. 3 and 4. The illuminated keyboard 3 comprises the plural keys 30, the fixing plate 31, the proximity sensor, a membrane switch circuit module 33, a metallic supporting plate 34, an illumination circuit board 35, at least one light-emitting element 36, and a light guide plate 37.

Each of the plural keys 30 comprises a keycap 301, an elastic element 302, and a connecting element 303. The proximity sensor comprises the induction antenna circuit 321 (indicated as oblique lines) and a signal processing unit 322. The membrane switch circuit module 33 comprises an upper wiring plate 331, an intermediate plate 332, and a lower wiring plate 333. For clarification and brevity, only one key 30 and parts of the fixing plate 31, the membrane switch circuit module 33, the metallic supporting plate 34, the illumination circuit board 35, the light-emitting element 36 and the light guide plate 37 are shown in FIG. 3.

The sequence of assembling the illuminated keyboard 3 will be illustrated in more details as follows. The plural keys 30 are disposed over the fixing plate 31. Both of the elastic element 302 and the connecting element 303 of each key 30 are arranged between the keycap 301 and the fixing plate 31. The elastic element 302 is fixed or fastened on the fixing plate 31, and connected with the keycap 301. The connecting element 303 is connected with the keycap 301 and the metallic supporting plate 34. In this embodiment, the connecting element 303 is a scissors-type connecting element, but is not limited thereto. An example of the fixing plate 31 includes but is not limited to a polyethylene terephthalate (PET) film.

Please refer to FIG. 4 again. In accordance with the features of the illuminated keyboard 3, the fixing plate 31 comprises plural openings 311, plural joining regions 312 and plural fixing regions 313; the plural elastic elements 302 of the plural keys 30 are fixed or fastened on the plural fixing regions 313 and the induction antenna circuit 321 (indicated as oblique lines) of the proximity sensor are formed on the plural joining regions 312. These features will be illustrated as follows.

Firstly, some of the plural openings 311 are formed in the portion of the fixing plate 31 under the corresponding keycap 301. A first fixing structure 341 and a second fixing structure 342 of the metallic supporting plate 34 are penetrated through the corresponding openings 311 of the fixing plate 31, and then connected with the connecting element 303 corresponding to the keycap 301.

Each of the plural fixing regions 313 is located at the portion of the fixing plate 31 under the corresponding keycap 30. In addition, the fixing region 313 is arranged between the openings 311 corresponding to the keycap 301 in order to fix the elastic element 302 corresponding to the keycap 301. Moreover, one joining region 312 is arranged between every two adjacent fixing regions 313. Through the joining region 312, the openings 311 between every two adjacent fixing regions 313 are connected with each other.

Then, as shown in FIG. 4, a sensing part 3211 of the induction antenna circuit 321 (indicated as oblique lines) is arranged between two adjacent rows of fixing regions 313. Moreover, plural connecting parts 3212 of the induction antenna circuit 321 (indicated as oblique lines) are also formed on the joining regions 312. Through the plural connecting parts 3212, the plural sensing parts 3211 are electrically connected with each other.

In this embodiment, the induction antenna circuit 321 (indicated as oblique lines) is a silver paste conductive line that is formed on the fixing plate 31 by a screen printing process, but is not limited thereto. In this embodiment, the induction antenna circuit 321 is formed on a top surface of the fixing plate 31. It is noted that the position of the induction antenna circuit 321 shown in the drawings is presented herein for purpose of illustration and description only. Alternatively, the induction antenna circuit 321 may be formed on a bottom surface of the fixing plate 31.

Then, the membrane switch circuit module 33 is disposed under the fixing plate 31. Please refer to FIG. 5. A first circuit pattern 3311 is formed on a bottom surface of the upper wiring plate 331. The first circuit pattern 3311 comprises plural upper contacts 3311*a*. A second circuit pattern 3331 is formed on a top surface of the lower wiring plate 333. The second circuit pattern 3331 comprises plural lower contacts 3331*a* corresponding to the plural upper contacts 3311*a*. Each of the upper contacts 3311*a* and the corresponding lower contact 3331*a* are collaboratively defined as a membrane switch 334. In addition, each membrane switch 334 is aligned with a corresponding key 30.

The intermediate plate 332 is arranged between the upper wiring plate 331 and the lower wiring plate 333 for separating the upper wiring plate 331 and the lower wiring plate 333 from each other. Consequently, each of the upper contacts 3311*a* and the corresponding lower contact 3331*a* are separated from each other by a spacing distance. In addition, the intermediate plate 332 has plural perforations 3321 corresponding to the plural upper contacts 3311*a*.

When one of the keycaps 301 is depressed, the keycap 301 is moved downwardly with the assistance of the connecting element 303. At the same time, the elastic element 302 is compressed by the keycap 301 and thus subject to deformation. Consequently, a protrusion part 3021 within the elastic element 302 is moved downwardly to push the membrane switch circuit module 33. Under this circumstance, the upper contact 3311*a* of the membrane switch 334 corresponding to the depressed keycap 301 is penetrated through the corresponding perforation 3321 and contacted with the corresponding lower contact 3331*a*. Consequently, the membrane switch circuit module 33 generates a corresponding key switch signal. According to the key switch signal, a corresponding function (e.g. a function of inputting a character, a symbol or a number into a computer system) is executed by the illuminated keyboard 3.

Moreover, the plural fixing regions 313 of the fixing plate 31 comprise plural holes 314, respectively. Consequently, the protrusion part 3021 within the elastic element 302 may be penetrated through the corresponding hole 314 of the fixing plate 31 to push the membrane switch circuit module 33.

Moreover, the metallic supporting plate 34 is disposed under the membrane switch circuit module 33 for enhancing the overall structural strength of the illuminated keyboard 3 and fixing the plural connecting element 303 of the plural keys 30. In this embodiment, the metallic supporting plate 34 is an iron plate, but is not limited thereto.

The connecting element 303 of each key 30 comprises a first frame 3031 and a second frame 3032. The first frame 3031 is pivotally coupled to the second frame 3032. In addition, the first frame 3031 and the second frame 3032 intersect each other. Two ends of the first frame 3031 are connected to an inner surface of the keycap 301 and the first fixing structure 341 of the metallic supporting plate 34, respectively. Two ends of the second frame 3032 are connected to the inner surface of the keycap 301 and the second fixing structure 342 of the metallic supporting plate 34. Moreover, the first fixing structure 341 and the second fixing structure 342 of the metallic supporting plate 34 are penetrated through the membrane switch circuit module 33 and the fixing plate 31, and exposed over the fixing plate 31.

Then, the light guide plate 37 is disposed under the metallic supporting plate 34. The light guide plate 37 is made of a transparent light-guiding material with low absorptivity and high refractivity to the light beam. An example of the transparent light-guiding material includes but is not limited to polycarbonate (PC), polymethylmethacrylate (PMMA), polyethylene terephthalate (PET) or silicone.

Afterwards, the illumination circuit board 35 is disposed under the light guide plate 37. In addition, the at least one light-emitting element 33 and the signal processing unit 322 are both disposed on the illumination circuit board 35, and electrically connected with the illumination circuit board 35 (see FIG. 6). It is noted that the shape of the illumination circuit board 35, the number and the position of the at least one light-emitting element 33 and the position of the signal processing unit 322 shown in the drawings are presented herein for purpose of illustration and description only. Moreover, an example of the illumination circuit board 35 includes but is not limited to a printed circuit board (PCB) or a flexible printed circuit (FPC).

Moreover, the signal processing unit 322 is electrically connected with the induction antenna circuit 321 by a thermal bonding process, but is not limited thereto. For example, in the thermal bonding process, the induction antenna circuit 321 and the signal processing unit 322 are connected with each other by an anisotropic conductive film (ACF). It is noted that the way of connecting the induction antenna circuit 321 and the signal processing unit 322 is not restricted.

The signal processing unit 322 may be penetrated through the fixing plate 31, the membrane switch circuit module 33, the metallic supporting plate 34 and the light guide plate 37, and received within the region under the keycap 301 of a specified key with a larger width (e.g. the keycap 301 of a space bar).

The light-emitting element 36 may be penetrated through the light guide plate 37. Consequently, the light beam from the light-emitting element 36 is laterally introduced into the light guide plate 37. The light beam from the light-emitting element 36 is transferred by the light guide plate 37, so that the light beam is diffused to the regions under all of the plural keys 30.

Hereinafter, the operating principles of the illuminated keyboard 3 of this embodiment will be illustrated in more details. In this embodiment, the proximity sensor is a capacitive sensor. When the illumination circuit board 35 is electrically conducted, an induction electric field is generated by the induction antenna circuit 321. Moreover, when an object (e.g. a human body) is located near the induction electric field, the induction electric field is subject to a change. According to the change of the induction electric field, the signal processing unit 322 electrically connected with the induction antenna circuit 321 may judge that the object enters a sensing range. Consequently, the signal processing unit 322 issues a sensing signal.

After the sensing signal from the signal processing unit 322 is received by the illuminated keyboard 3, a controlling unit (not shown) of the illuminated keyboard 3 drives illumination of the light-emitting element 36 in response to the sensing signal. Consequently, the illuminating function of the illuminated keyboard 3 is enabled. Moreover, in response to the sensing signal, the controlling unit of the illuminated keyboard 3 may issue a command to a computing device that is connected with the illuminated keyboard 3. According to the command, the computing device is waked up from a sleep mode or a hibernation mode. An example of the computing device includes but is not limited to a desktop computer or a notebook computer.

When the object is far away from the induction electric field, which is generated by the induction antenna circuit 321, the object is no longer within the sensing range. Meanwhile, the induction electric field is also subject to a change. According to the change of the induction electric field, the signal processing unit 322 will notify the controlling unit of the illuminated keyboard 3 to stop driving illumination of the light-emitting elements 36. Under this circumstance, the illuminating function of the illuminated keyboard 3 is disabled. In other words, by judging whether the user enters the sensing range of the illuminated keyboard 3, the illuminating function of the illuminated keyboard 3 can be automatically enabled or disabled.

Figure 7:
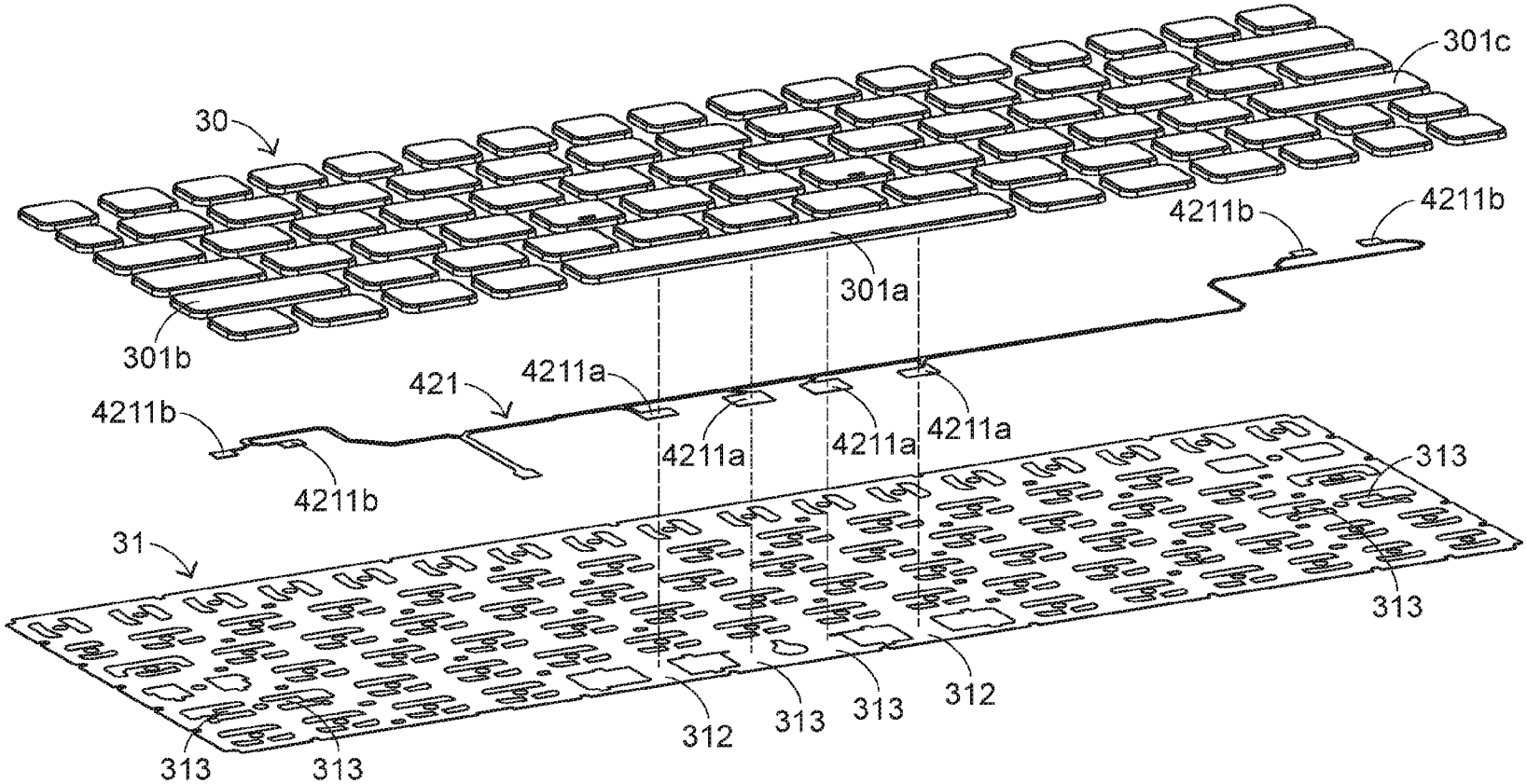
FIG. 7 schematically illustrates a second exemplary induction antenna circuit used in the illuminated keyboard of the present invention.
Figure 8:
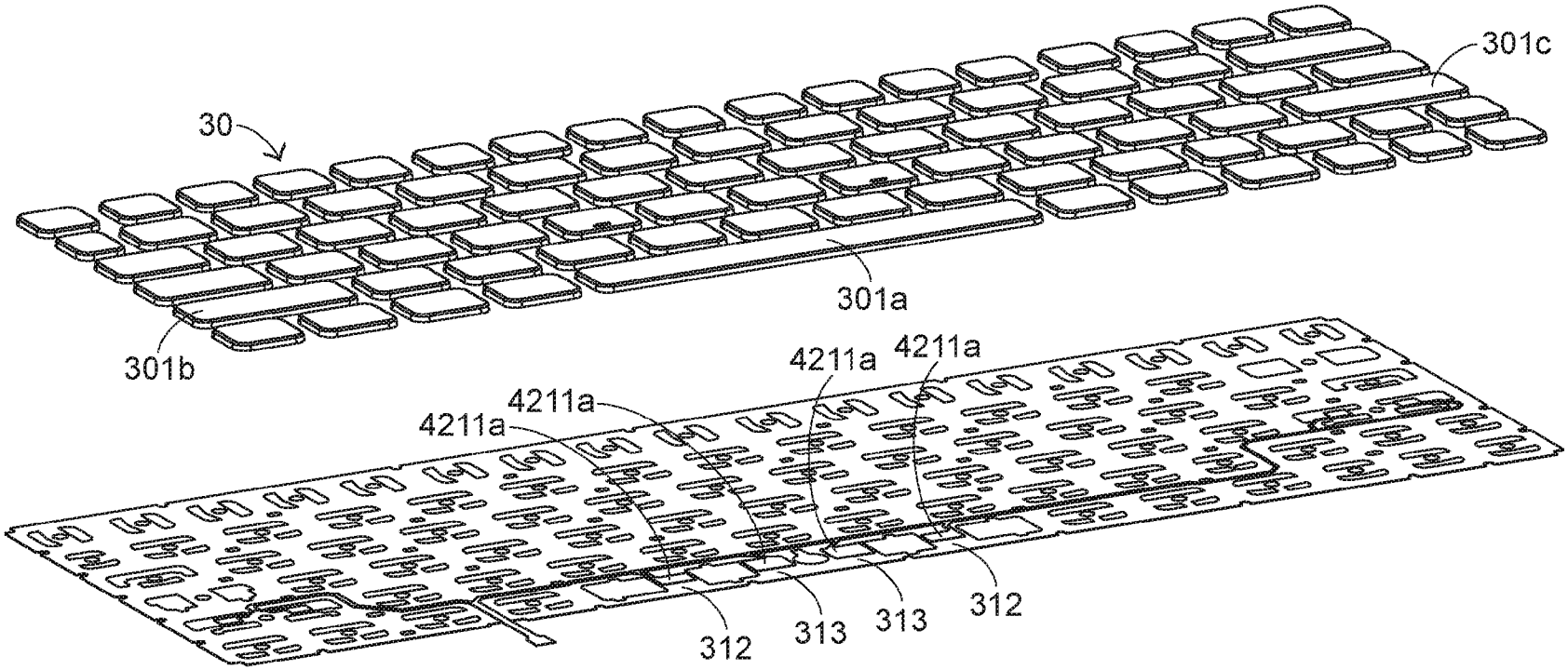
FIG. 8 schematically illustrates a second exemplary induction antenna circuit used in the illuminated keyboard of the present invention.

FIGS. 7 and 8 schematically illustrate a second exemplary induction antenna circuit used in the illuminated keyboard of the present invention. The induction antenna circuit 321 is replaced by the induction antenna circuit 421 of FIG. 7. The second exemplary induction antenna circuit 421 comprises eight sensing parts, including four sensing parts 4211*a* and four sensing parts 4211*b*. The four sensing parts 4211*a* are formed on the fixing region 313 of the fixing plate 31 under a specified keycap 301*a* and the joining regions 312 at bilateral sides of this fixing region 313 as shown in FIG. 8.

Moreover, two of the four sensing parts 4211*b* of the induction antenna circuit 421 are formed on the fixing region 313 of the fixing plate 31 which is under another specified keycap 301*b*, and the other two of the four sensing parts 4211*b* are formed on the fixing region 313 of the fixing plate 31 which is under another specified keycap 301*c*. In this embodiment, the induction antenna circuit 421 is formed on a top surface of the fixing plate 31. Alternatively, in some other embodiments, the fixing plate 31 is formed on a bottom surface of the fixing plate 31.

In this embodiment, the keycap 301*a* is a keycap of a space bar, but is not limited thereto. The keycap 301*b* is a keycap of a Shift key, and the keycap 301*c* is a keycap of an Enter key, but is not limited thereto.

From the above descriptions, by the proximity sensor of the illuminated keyboard of the present invention, the illuminating function of the illuminated keyboard is automatically enabled or disabled. Moreover, since the induction antenna circuit is formed on the fixing plate, the layout area of the induction antenna circuit increases. Moreover, since the induction antenna circuit is far from the metallic supporting plate, the possibility of causing the signal interference problem will be minimized. In addition, the illuminated keyboard can meet the requirements of light weightiness, slimness and miniaturization.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

at least one light-emitting element providing a light beam to the illuminated keyboard;

a membrane switch circuit module generating plural key switch signals;

plural keys disposed over the membrane switch circuit module, wherein when one of the plural keys is depressed, the membrane switch circuit module generates the corresponding key switch signal, respectively, wherein each of the plural keys comprises an elastic element and a keycap connected with the elastic element;

a fixing plate arranged between the membrane switch circuit module and the plural keys, wherein the fixing plate comprises:

plural openings disposed under each of the plural keycaps;

plural fixing regions disposed under the plural keycaps, respectively, wherein each of the plural fixing regions is arranged between the plural openings under the corresponding keycap so as to fasten the corresponding elastic element, wherein each of the plural fixing regions has a hole, and the corresponding elastic element is penetrable through the hole to push the membrane switch circuit module; and plural joining regions, wherein the openings between the plural fixing regions are connected with each other through the plural joining regions; and a proximity sensor sensing whether an object enters a sensing range, wherein the proximity sensor comprises an induction antenna circuit, and the induction antenna circuit is formed on the plural joining regions or the plural fixing regions of the fixing plate.

2. The illuminated keyboard according to claim 1, wherein one sensing part of the induction antenna circuit is formed on the joining region between two adjacent rows of fixing regions.

3. The illuminated keyboard according to claim 1, wherein plural sensing parts of the induction antenna circuit are formed on the fixing region under a specified keycap and the joining regions at bilateral sides of the fixing region.

4. The illuminated keyboard according to claim 3, wherein the specified keycap is a keycap of a space bar.

5. The illuminated keyboard according to claim 1, wherein one sensing part of the induction antenna circuit is formed on the fixing region under a specified keycap.

6. The illuminated keyboard according to claim 5, wherein the specified keycap is a keycap of a Shift key or a keycap of an Enter key.

7. The illuminated keyboard according to claim 1, wherein the proximity sensor further comprises a signal processing unit, and the signal processing unit is electrically connected with the induction antenna circuit, wherein when the induction antenna circuit senses that the object enters the sensing range, the signal processing unit issues a sensing signal.

8. The illuminated keyboard according to claim 7, wherein in response to the sensing signal from the signal processing unit, the at least one light-emitting element provides the light beam to the illuminated keyboard.

9. The illuminated keyboard according to claim 7, wherein in response to the sensing signal from the signal processing unit, a computing device which is connected with the illuminated keyboard is waked up from a sleep mode or a hibernation mode.

10. The illuminated keyboard according to claim 7, wherein the illuminated keyboard further comprises an illumination circuit board, and the at least one light-emitting element is supported on the illumination circuit board, wherein the induction antenna circuit and the signal processing unit are electrically connected with the illumination circuit board.

11. The illuminated keyboard according to claim 1, wherein the membrane switch circuit module comprises:

an upper wiring plate having a first circuit pattern, wherein the first circuit pattern comprises plural upper contacts;

a lower wiring plate having a second circuit pattern, wherein the second circuit pattern comprises plural lower contacts corresponding to the plural upper contacts, wherein each of the upper contacts and the corresponding lower contact are collaboratively defined as a membrane switch; and an intermediate plate arranged between the upper wiring plate and the lower wiring plate, so that each of the upper contacts and the corresponding lower contact are separated from each other by a spacing distance, wherein the intermediate plate comprises plural perforations corresponding to the plural upper contacts.

12. The illuminated keyboard according to claim 1, wherein the illuminated keyboard further comprises a light guide plate, and the light guide plate is disposed under the membrane switch circuit module, wherein the light beam from the at least one light-emitting element is transferred by the light guide plate.

13. The illuminated keyboard according to claim 1, wherein the illuminated keyboard further comprises a metallic supporting plate, and the metallic supporting plate is disposed under the membrane switch circuit module, wherein each of the plural keys further comprises a connecting element, and the connecting element is connected with the corresponding keycap and the metallic supporting plate.

* * * * *